US010317024B2

(12) United States Patent
Liu et al.

(10) Patent No.: US 10,317,024 B2
(45) Date of Patent: Jun. 11, 2019

(54) LED STRIP LIGHT

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Xiaoyun Liu, Zhejiang (CN); Guoqing Zeng, Zhejiang (CN); Jianguo Dong, Zhejiang (CN); Zuping He, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/820,018

(22) Filed: Nov. 21, 2017

(65) Prior Publication Data

US 2018/0142846 A1 May 24, 2018

(30) Foreign Application Priority Data

Nov. 22, 2016 (CN) ..... 2016 1 1041042

(51) Int. Cl.

| | |
|---|---|
| ***F21S 4/28*** | (2016.01) |
| ***F21V 3/02*** | (2006.01) |
| ***A47B 97/00*** | (2006.01) |
| ***F21V 5/04*** | (2006.01) |
| ***F21V 17/16*** | (2006.01) |
| ***F21V 19/00*** | (2006.01) |
| ***F21W 131/301*** | (2006.01) |
| ***F21V 33/00*** | (2006.01) |
| ***F21V 7/04*** | (2006.01) |
| ***F21V 9/14*** | (2006.01) |

(Continued)

(52) U.S. Cl.

CPC ..... *F21S 4/28* (2016.01); *A47B 97/00* (2013.01); *A47F 11/10* (2013.01); *F21V 3/02* (2013.01); *F21V 7/04* (2013.01); *F21V 9/14* (2013.01); *F21V 17/16* (2013.01); *F21V 19/003* (2013.01); *F21V 19/0015* (2013.01); *F21V 33/0012* (2013.01); *A47B 2220/0077* (2013.01); *F21V 5/04* (2013.01); *F21W 2131/301* (2013.01); *F21Y 2103/10* (2016.08); *F21Y 2115/10* (2016.08)

(58) Field of Classification Search

None

See application file for complete search history.

(56) References Cited

U.S. PATENT DOCUMENTS

2011/0044030 A1* 2/2011 Pichel ..... A47F 11/10 362/125

* cited by examiner

*Primary Examiner* — Kristy A Haupt

(74) *Attorney, Agent, or Firm* — Wang Law Firm, Inc.

(57) ABSTRACT

An LED strip light for cabinet lighting includes a strip-shaped lamp holder, and a light-emitting module. The strip-shaped lamp holder includes a first mounting surface and a second mounting surface and two light source slots. The angle between the light source mounting surface formed by the two light source slots and the first mounting surface is an acute angle between 30 and 40 degrees. Two mounting groove is respectively provided on the first mounting surface and the second mounting surface along the extending direction thereof. One mounting groove is a U-shaped groove and another is a V-shaped groove. It is easier to install the LED strip light in the strip-shaped lamp holder and more mounting options can be selected so that the LED strip light is more suitable for cabinets such as shelf laminates, vertical freezers and horizontal freezers, etc.

9 Claims, 8 Drawing Sheets

(51) Int. Cl.

| | |
|---|---|
| ***A47F 11/10*** | (2006.01) |
| *F21Y 103/10* | (2016.01) |
| *F21Y 115/10* | (2016.01) |

LED STRIP LIGHT

RELATED APPLICATION

This application claims priority to Chinese Patent Application No. CN201611041042.5, filed on Nov. 22, 2016.

BACKGROUND

1. Technical Field

The present invention relates to lighting apparatus field, with particular emphasis on an LED strip light.

2. Description of the Related Art

In ordinary daily life, all kinds of lighting apparatus can be seen everywhere, such as fluorescent lamps, street lamps, table lamps, artistic lamps and so on. In the above-described lighting apparatus, the tungsten bulb is traditionally used as a light-emitting light source. In recent years, due to the ever-changing technology, light-emitting diode (LED) has been used as a light source. Moreover, in addition to lighting apparatus, for the general traffic signs, billboards, headlights etc., light-emitting diode (LED) has also been used as a light source. The light-emitting diode (LED) as a light source has the advantages of energy-saving and greater brightness. Therefore, it has been gradually common.

With the popularity of LED lamps, more and more occasions began to use LED lamps. For the increasingly common use of LED strip lights, its installation has become the focus of attention.

BRIEF DESCRIPTION OF THE DRAWINGS

The drawings described herein are intended to promote a further understanding of the present invention, as follows.

DETAILED DESCRIPTION OF THE INVENTION

Figure 1:
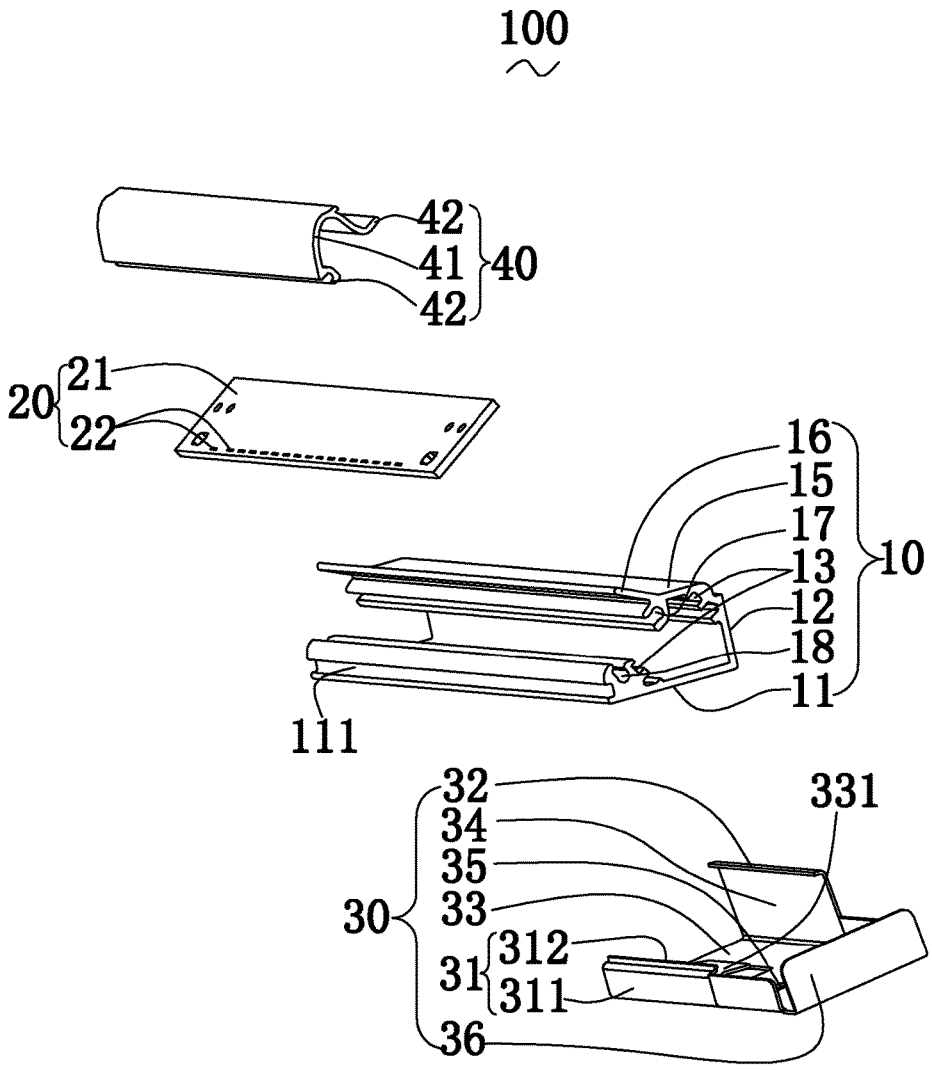
FIG. 1 is a schematic view of an exploded structure of an LED strip light provided in the first embodiment of the present invention.
Figure 2:
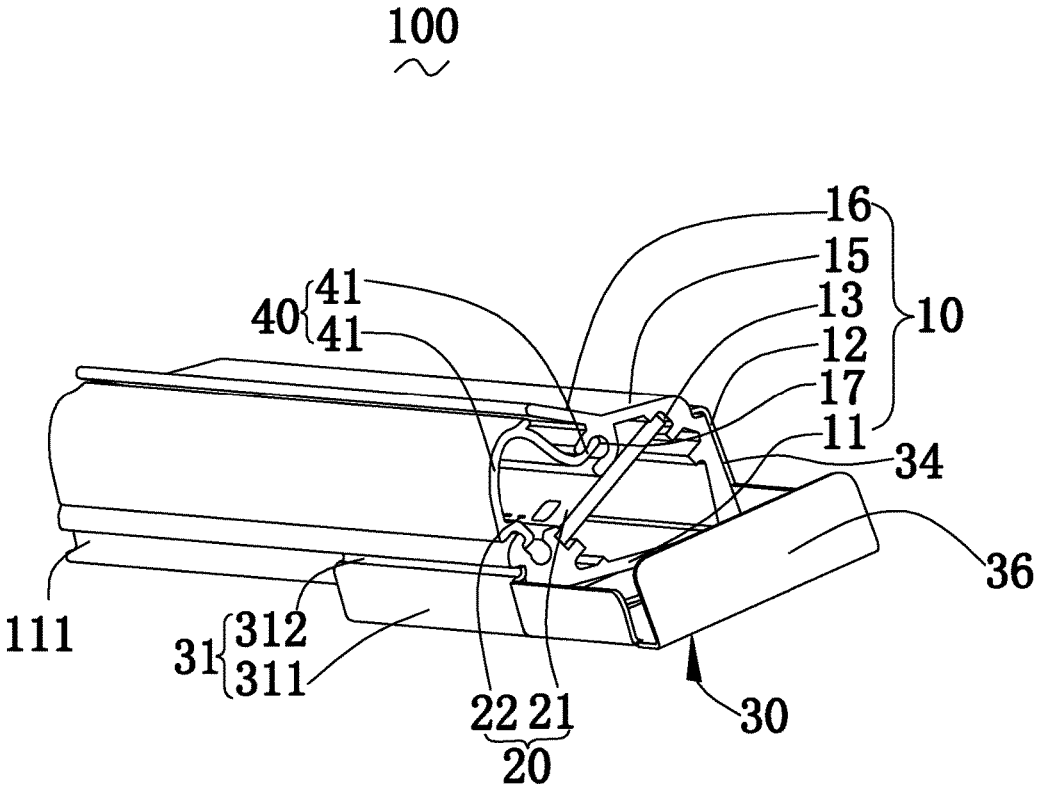
FIG. 2 is a schematic view showing the assembling structure of the LED strip light of FIG. 1.
Figure 3:
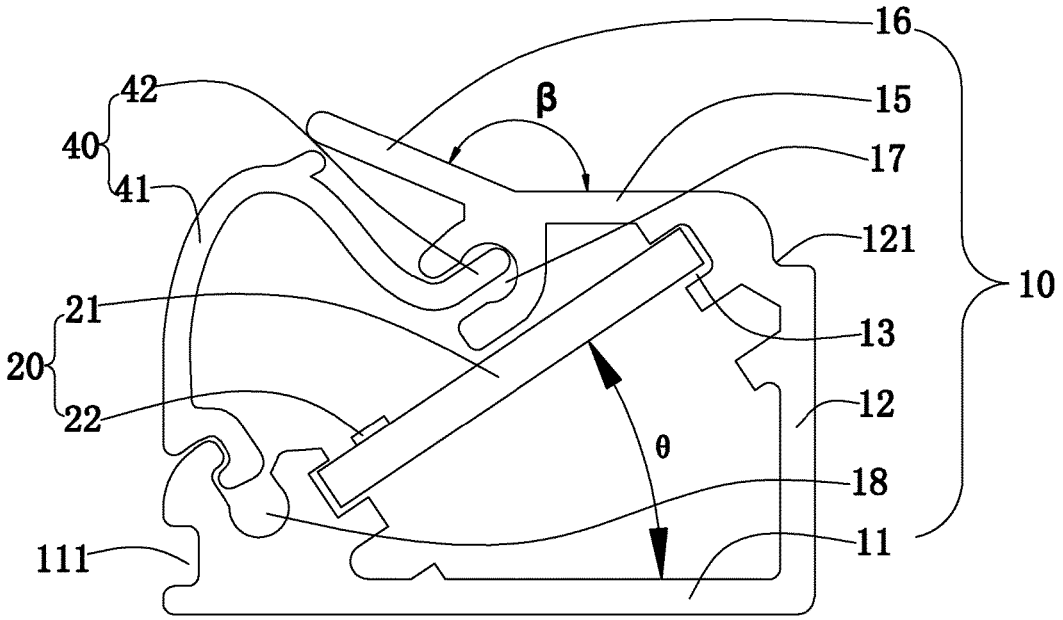
FIG. 3 is a front view of the LED strip light without the laminar mounting clip of FIG. 1.

The present application is illustrated by way of the following detailed description based on of the accompanying drawings. It should be noted that illustration to the embodiment in this application is not intended to limit the invention.

Referring to FIG. 1 to FIG. 4, these FIGs are schematic views of the structure of an LED strip lamp 100 provided in the first embodiment of the present invention. The LED strip light 100 is used for cabinet lighting. It should be understood by those skilled in the art that the inside of the cabinet may be laminates in a shelf, a vertical freezer or a horizontal freezer, which are generally used in shopping malls and stores where the LED strip light 100 is required to illuminate the sale of goods. The LED strip light 100 includes a strip-shaped lamp holder 10, and a light-emitting module 20 disposed within the strip-shaped lamp holder 10, a laminar mounting clip 30 provided on the strip-shaped lamp holder 10, a lampshade 40 provided on the strip-shaped lamp holder 10. It is contemplated that the LED strip light 100 also includes other functional modules such as a power supply module, a power plug assembly, and an end cap provided at both ends of the strip-shaped lamp holder 10, a waterproof component, etc., which are well known to those skilled in the art and will not be described in detail here.

The strip-shaped lamp holder 10 includes a first mounting surface 11 and a second mounting surface 12 which are adjacent and perpendicular to each other, and two light source slots respectively set at the radial free ends of the first and second mounting surfaces 11, 12, a lampshade connection edge 15 perpendicular to the second mounting surface 12, a light-barrier reflective strip 16 provided on the free side of the lampshade connection edge 15, a first lampshade groove 17 provided on the lampshade connection edge 15, a second lampshade groove 18 provided on the first mounting surface 11. The strip-shaped lamp holder 10 can be made of a metal excellent in heat dissipation performance, such as an aluminum alloy or an aluminum-magnesium alloy. The first and second mounting surfaces 11, 12 are different mounting surfaces which can be respectively used when the LED strip light 100 is installed in a different environment, so that the exit light of the LED strip light 100 can be emitted to a different area through different surfaces, for example, when the LED strip lamp 100 is used on a shelf, the first mounting surface 11 is mounted in conformity with the laminates of the shelf, and when the LED strip light 100 is used for the vertical freezer, the second mounting surface 12 will be fitted to the post of the vertical freezer. The first and second mounting surfaces 11, 12 both are flat so as to facilitate installation, and the length of the cross-section of the first mounting surface 11 is greater than that of the second mounting surface 12 to assembly the light source module 20. The first and second mounting surfaces 11, 12 are respectively provided with a mounting groove 111, 121 in the extending direction thereof, one of the two mounting grooves 111, 121 is a U-shaped groove and another is V-shaped groove. In the present embodiment, the mounting groove 111 provided in the first mounting surface 11 is a U-shaped groove, and the mounting groove 121 provided in the second mounting surface 12 is a V-shaped groove. The two light source slots 13 are provided for inserting the light source module 20, and the structure is a groove for inserting the following circuit board 21 included in the light source module 20. The angle between the light source mounting surface formed by the two light source slots and the first mounting surface being an acute angle θ between 30 and 40 degrees. The light source mounting surface formed by the two light source slots 13 is the plane in which the circuit board 21 is located, and the angle between the plane and the first mounting surface 11 is an acute angle. In order to apply the LED strip light 100 to a special environment, i.e., cabinet lighting, the angle between the plane and the first mounting surface 11 should be limited to between 30 degrees and 40 degrees, then excellent light distribution effect can be achieved. In order to protect the light source module 20 and to achieve a certain light effect such as a polarizing or line light source, the strip-shaped lamp holder 10 is provided with the lampshade connection edge 15 extending vertically from the second mounting surface 12 so that the lampshade connection edge 15, the lampshade 40, and the first and second mounting surfaces 11, 12 may form an inner cavity to set and protect the light source module 20. The lampshade connection edge 15 serves to increase the cross-sectional area of the inner cavity. When the length of the cross-section of the first and second mounting surfaces 11, 12 is large enough, the shade connection side 15 may not be used. The light-barrier reflective strip 16 is provided on the free side of the lampshade connection edge 15, and the length of the cross section of the first mounting surface 12 is larger than the length of the cross section of the second mounting surface, and the angle between the light source mounting surface and the first mounting surface 11 is between 30 and 40 degrees, so that the exit light of the light source module 20 can be is emitted toward the second mounting surface 12. In order to prevent glare, the light-barrier reflective strip 16 needs to keep out the glare to avoid discomfort the glare into the human eye and then avoid discomfort. The angle between the light-barrier reflective strip 16 and the first mounting surface 11 is an acute angle β less than 25 degrees. Since the angle θ between the light source mounting surface and the first mounting surface 11 is between 30° and 40° and the LED strip light 100 is used for cabinet lighting, when the angle β between the light-barrier reflective strip 16 and the first mounting surface 11 is less than 25 degrees, then most of the glare can be prevented. No matter what the user observe the goods displayed within the cabinet from any perspective, the glare can't enter into the human eye and then shopping experience can be improved for people. The first lampshade groove 17 is provided on side of the free end of the lampshade connection edge 15 and the second lampshade groove 18 is provided on one side of the free end of the first mounting surface 11, the first and lampshade grooves 17, 18 are used to insert the lampshade 40, and it is conceivable that the first and lampshade grooves 17, 18 should be respectively located on outside of the two light source slots 13.

The light source module 20 includes a circuit board 21 and a plurality of LED chips 22 arranged in an axially spaced arrangement along the lamp holder. The circuit board 21 is well known in the art for electrically connecting with the plurality of LED chips 22. The circuit board 21 includes various functional wires and even some electronic components such as transistors, diodes, resistors, etc., so that the plurality of LED chips 22 can operate normally. The LED (Light Emitting Diode) chip 22 serves as a light source for emitting light. It is contemplated that each LED chip 22 is a point light source for uniform lighting at the exit angle formed by the primary encapsulation of the LED chip. In the present embodiment, the LED chips 22 are arranged in a plurality of rows and equally spaced and the LED chips 22 are provided on the circuit board 21.

Figure 4:
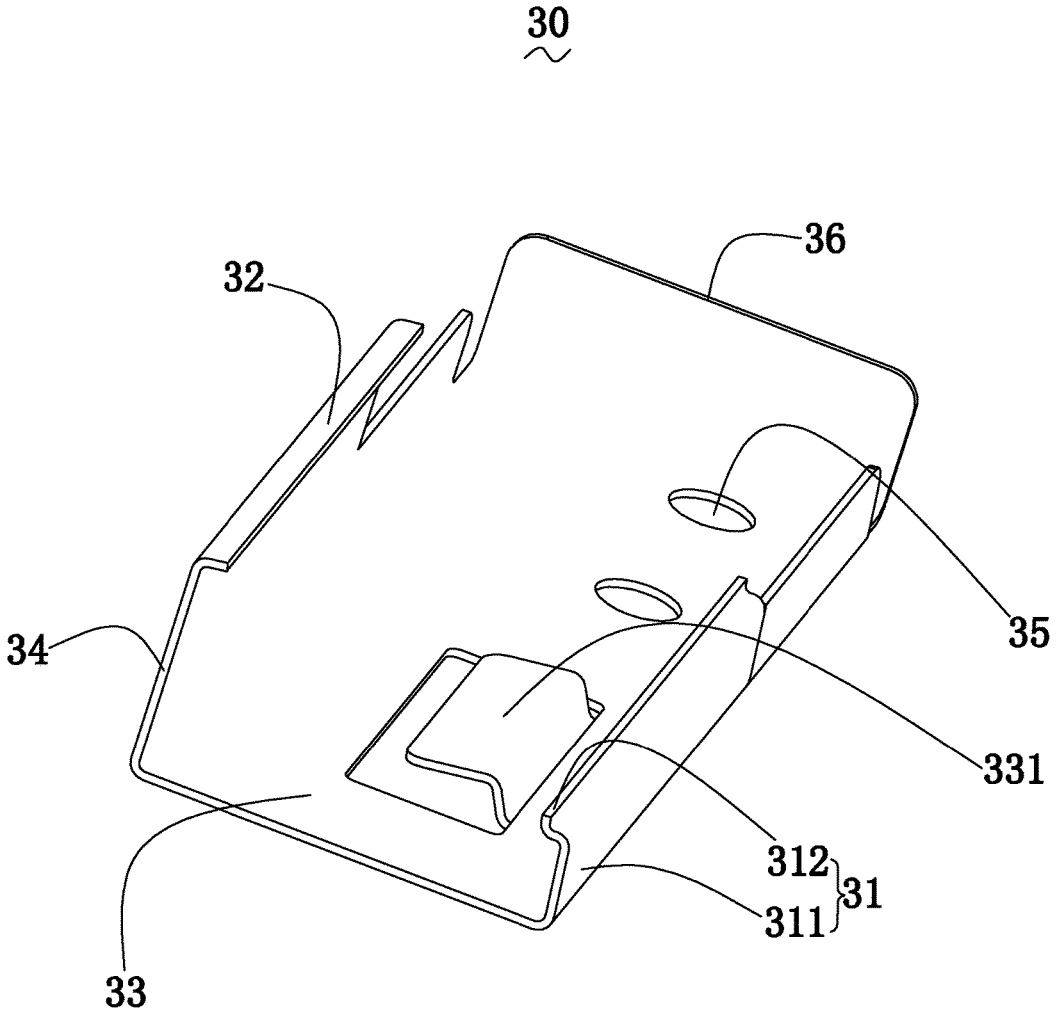
FIG. 4 is a schematic perspective view of the LED strip with the laminar mounting clip of FIG. 1.

Please also referring to FIG. 4, the laminar mounting clip 30 is adapted to be mounted on laminates of the shelf, which includes a laminar U-shaped groove engaging portion 31 and a laminar V-shaped groove engaging portion 32, a laminar mounting abutment plate 33 connecting to the laminar U-shaped groove engaging portion 31 and the laminar V-shaped groove engaging portion 32, a laminar connecting portion 34 connecting with the laminar V-shaped groove engaging portion 32 and the laminar mounting abutment plate 33. The laminar U-shaped groove engaging portion 31 includes a laminar transition portion 311 vertical to the laminar mounting abutment plate 33 and an L-shaped structure 312 connecting with the laminar transition portion 311. One side of the L-shaped structure 312 is connected to the laminar transition portion 312 and the other is inserted into the U-shaped groove. It is conceivable that the height of the laminar transition portion 312 may be set according to actual requirements such as the thickness of the first mounting surface 11 and the like. In addition, since the laminar U-shaped groove engaging portion 31 is clamped into the U-shaped groove, a support function may be provided. Since the laminar V-shaped groove engaging portion is clamped into the V-shaped groove, a buckle function may be provided. It is also possible to adjust the angle of the first mounting surface 11 with respect to the laminar mounting abutment plate 33 by adjusting the height of the laminar transition portion 312 so that the angle of the first mounting surface 11 with respect to the laminates can be adjusted, and then the light emitting direction of the LED strip lamp 100 with respect to the laminates can further be adjusted. The laminar V-shaped groove engaging portion 32 includes a laminar engaging edge connecting with the laminar connecting portion 34, the angle between the laminar engaging edge and the laminar connecting portion 34 is less than or equal to 90 degrees, the laminar engaging edge is clamped into the V-shaped groove, the laminar mounting abutment plate 33 is coupled to the first mounting surface 11 of the strip-shaped lamp holder 10. When assembling, the laminar U-shaped groove engaging portion 31 should be engaged with the U-shaped groove and the laminar mounting abutment plate 33 is fitted to the first mounting surface 11 so that the laminar connecting portion 34 can be attached to the second mounting surface 12, at last the laminar mounting abutment plate 33 presses the first mounting surface 11 so that the laminar engaging edge of the laminar V-shaped groove engaging portion 32 can be clamped into the V-shaped groove, to achieve the aim that the strip-shaped lamp holder 10 can be assembled into the laminar mounting clip 30. The height of the laminar connecting portion 34 should be greater than the height of the laminar transition portion 312 so that the V-shaped groove engaging portion 32 can be firmly clamped into the V-shaped groove and then the V-shaped groove engaging portion 32 can be more resilient. The laminar mounting abutment plate 33 includes a laminar spring 331 extending toward the first mounting surface. The laminar spring 331 abuts against the first mounting surface 11 so that the laminar V-shaped groove engaging portion 32 and the laminar U-shaped groove engaging portion 31 are respectively clamped into the V-shaped groove and the U-shaped groove.

The laminar mounting clip 30 includes a blocking portion 35 extending vertically from one end of the laminar mounting abutment plate 33 and at least one laminar mounting hole 36 mounted on the laminar mounting abutment plate 33. When mounting the strip-shaped lamp holder 10, at first, the fastener, such as a screw, should pass through the layer mounting hole 35 and be fastened on the laminates, and then the strip-shaped lamp holder 10 is clamped into the laminar mounting clip 30 according to the way as described above. The blocking portion 35 can prevent the false engaging position of the strip-shaped lamp holder 10 and can suspend the laminar mounting clip 30 and the strip-shaped lamp holder 10 to a device such as the arm on the shelf.

The lampshade 40 includes a light-emitting portion 41, and two insertion portions 42 respectively provided on both sides of the light-emitting portion 41 which is a plate type lampshade made of a translucent material. The cross-sectional shape of the light-emitting portion 41 is that the side of the contour line of the light-emitting portion 41 which is in contact with the light-barrier reflective strip 16 is tangent to the light-barrier reflective strip 16. The side of the contour line of the light-emitting portion 41, which is in contact with the second lampshade groove 18, is tangent to the second lampshade groove 18. The side of the contour line of the light-emitting portion 41 is in contact with the light-barrier reflective strip 16 and the outer end of the second lampshade groove continuously transits. The structure of the LED strip light 100 is made more beautiful by the structure of the light emitting portion 41 as described above, and the light emitting portion 41 is further moved away from the light source module 20 to achieve the purpose of forming a line light source. When the LED strip light 100 works, even one luminous LED chip 22 will not be seen from the outside of the light.

As described above, as the LED strip light 10 includes the first and second mounting surfaces 11, 12 and U-shaped and V-shaped mounting groove 14 respectively installed in the first and second mounting surfaces 11, 12, it is easier to install the LED strip light 100 and can be more installations. Meanwhile, as the angle between the light source mounting surface and the first mounting surface 11 is an acute angle between 30 to 40 degrees, the LED strip light 100 is more suitable for cabinet lighting such as shelves laminates, vertical freezers, horizontal freezers, etc.

Figure 5:
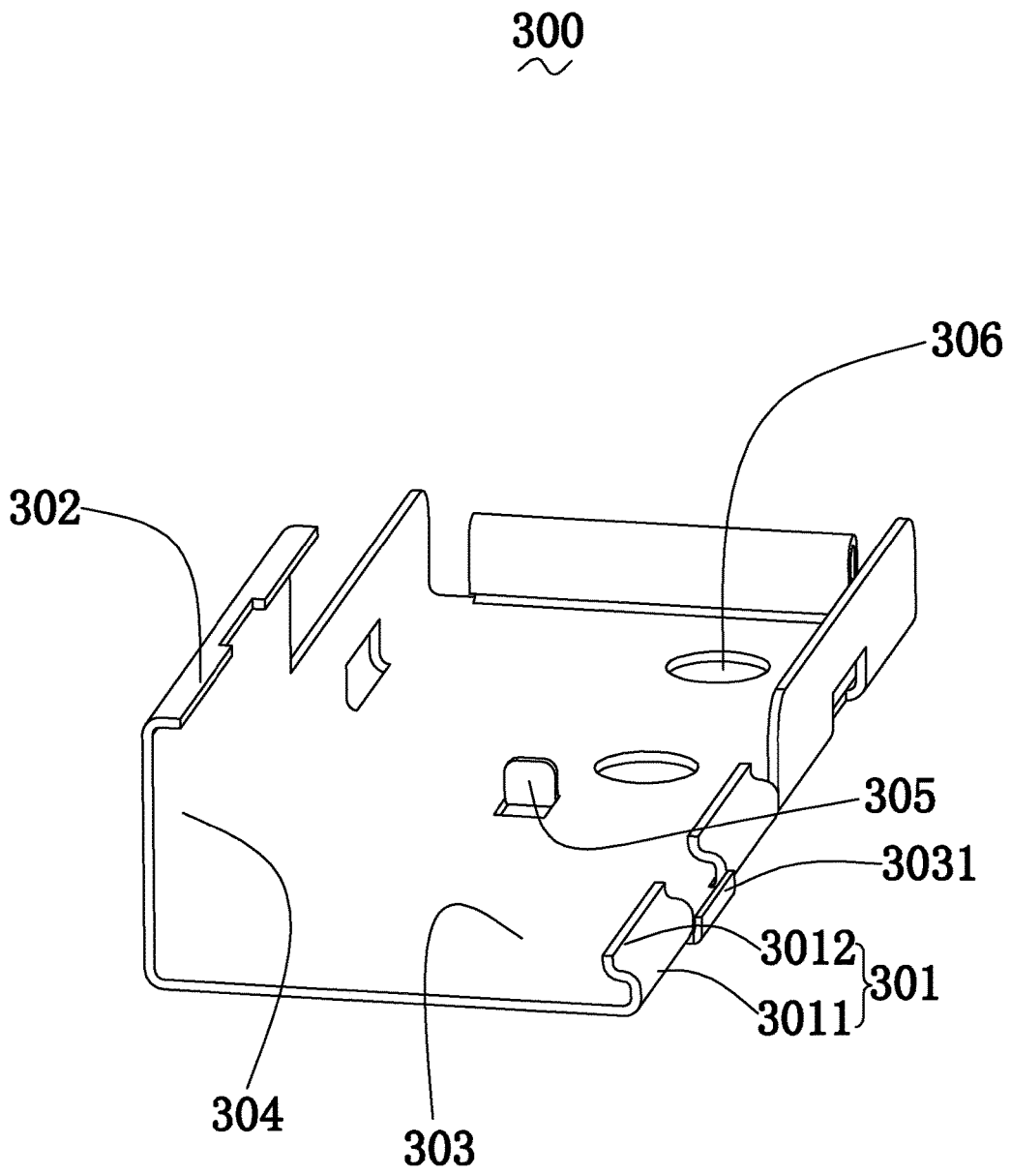
FIG. 5 is a schematic view of the structure of a horizontal mounting clip suitable for installation in a horizontal freezer provided by the second embodiment of the present invention.

Referring to FIG. 5, FIG. 5 is a schematic view of the structure of a horizontal mounting clip 300 suitable for installation in a horizontal freezer provided by the second embodiment of the present invention. It is conceivable that different mounting clips are suitable for different applications without changing the structure of the strip-shaped lamp holder 10 to improve adaptability and replaceability of the light. The horizontal cabinet mounting clip 300 is mounted on the side wall of the horizontal freeze, and it includes a horizontal cabinet U-shaped groove engaging portion 301, a horizontal cabinet V-shaped groove engaging portion 302, a horizontal cabinet mounting abutment plate 303 connecting with the horizontal cabinet U-shaped groove engaging portion 301 and the cabinet V-shaped groove engaging portion 302, and a horizontal cabinet connecting portion 304 connecting with the horizontal cabinet V-shaped groove engaging portion 302 and the horizontal cabinet mounting abutment plate 303.

The horizontal cabinet U-shaped groove engaging portion 301 includes a horizontal cabinet transition portion 3011 vertical to the horizontal cabinet mounting abutment plate 302, and an L-shaped structure 3012 connecting with the horizontal cabinet transition portion 3011. One side of the L-shaped structure 3012 is connected to the horizontal cabinet transition portion 3011 and the other is inserted into the U-shaped groove of the strip-shaped lamp holder 10.

And same as the laminar mounting clip 30, the height of the sleeper transition portion 3011 can be set according to the actual requirement such as the thickness of the first mounting surface 11 and the like. In addition, since the horizontal cabinet U-shaped groove engaging portion 301 is clamped into the U-shaped groove, a support function may be provided. Since the horizontal cabinet V-shaped groove engaging portion is clamped into the V-shaped groove, a buckle function may be provided. It is also possible to adjust the angle of the first mounting surface 11 with respect to the horizontal cabinet mounting abutment plate 303 by adjusting the height of the horizontal cabinet transition portion 3011 so that the angle of the first mounting surface 11 with respect to the one side of the horizontal cabinet can be adjusted, and then the light emitting direction of the LED strip lamp 100 with respect to the one side of the horizontal cabinet can further be adjusted. The horizontal cabinet V-shaped groove engaging portion 302 includes a horizontal cabinet engaging edge connecting with the horizontal cabinet connecting portion 303. The angle between the horizontal cabinet engaging edge and the horizontal cabinet connecting portion 303 is less than or equal to 90 degrees, and the horizontal cabinet engaging edge is clamped into the V-shaped groove.

The horizontal cabinet mounting abutment plate is coupled to the first mounting surface of the strip-shaped lamp holder 10 and includes a horizontal cabinet spring lamination 3031 extending toward the first mounting surface 11. The horizontal cabinet spring lamination 3031 abuts against the first mounting surface 11. The horizontal cabinet spring lamination 3031 is mounted on the horizontal cabinet connecting portion 304, and the horizontal cabinet connecting portion 304 is coupled to the second mounting surface 12 of the strip-shaped lamp holder 10.

Further, the horizontal cabinet mounting clip 300 further includes a blocking portion 305 extending vertically from one end of the horizontal cabinet mounting abutment plate 303, and at least one horizontal cabinet mounting hole 306 mounted on the horizontal cabinet mounting abutment plate 303. The horizontal cabinet mounting hole 306 and the horizontal cabinet U-shaped and V-shaped groove engaging portions 301, 302 are respectively located on both sides of the blocking portion 305. It is well known that, due to the structure of the horizontal freezer itself, the horizontal freezer generally has a push-pull freezer flip and the edge of the freezer cover is opaque. The opaque portion of the freezer flip can be partly overlapped with the horizontal cabinet mounting hole 306 so that it is easy to install, meanwhile the position of the blocking portion 305 can be appropriately adjusted to adjust the position of the entire LED strip light 100.

Figure 6:
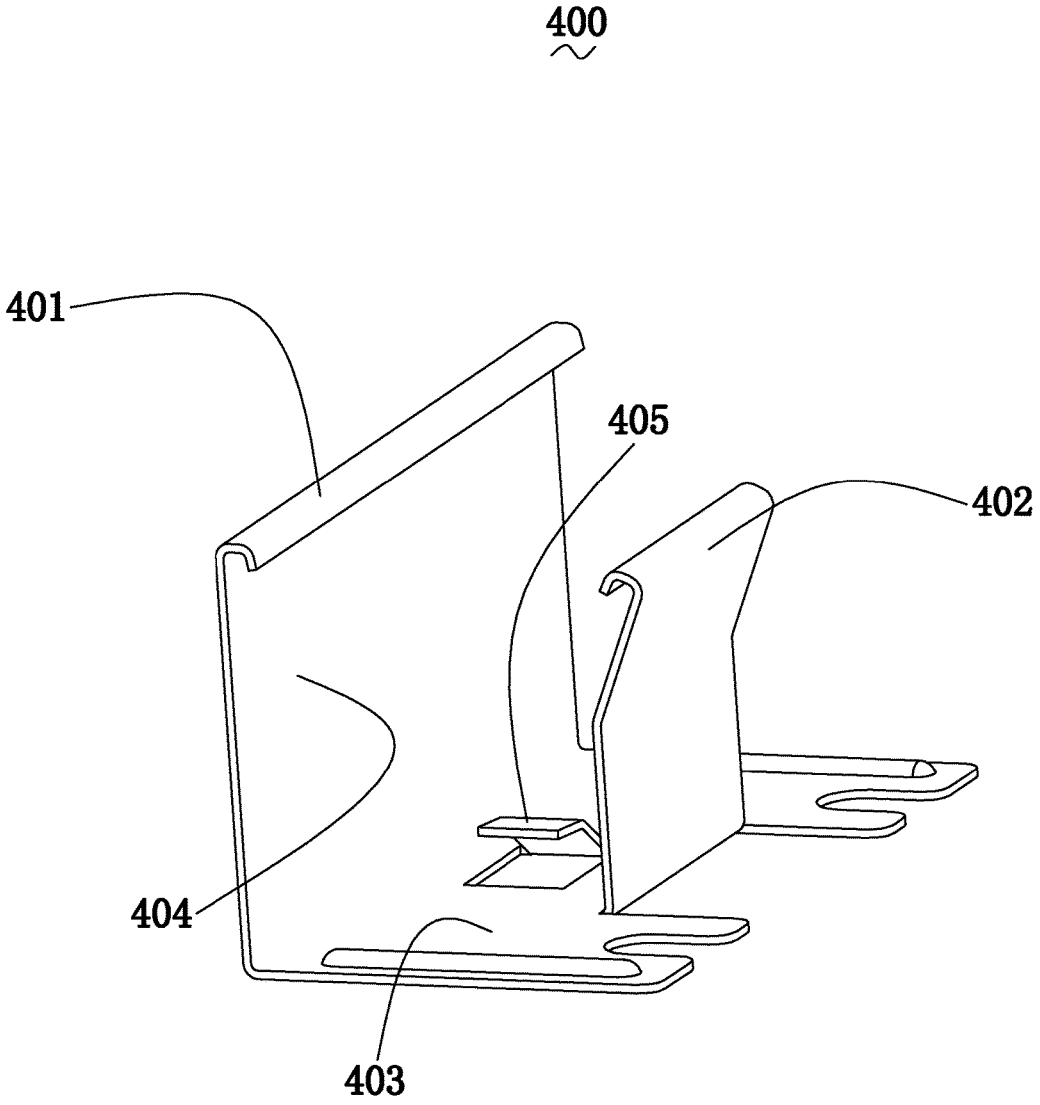
FIG. 6 is a schematic view of the structure of a post mounting clip suitable for installation in a vertical freezer provided by the third embodiment of the present invention.

As shown in FIG. 6, FIG. 6 is a schematic view of the structure of a post mounting clip 400 suitable for installation in a vertical freezer provided by the third embodiment of the present invention. The post mounting clip 400 includes a U-shaped groove engaging hook 401, a light-barrier engaging hook 402 and a first post mounting abutment plate 403 connecting with the U-shaped groove engaging hook 401, and a second post mounting abutment plate 404 coupled to the second mounting surface 12.

The U-shaped groove engaging hook 401 is hook up in the U-shaped groove of the strip-shaped lamp holder 10. The light-barrier engaging hook 402 is hook up at the free end of the light-barrier reflective strip 16. The first post mounting abutment plate 403 is fitted to the first mounting surface 12 of the strip-shaped lamp holder 10. The second post mounting abutment plate 404 is fitted to the second mounting surface 12 and includes a post spring lamination 405 extending toward the second mounting surface 12. The post spring lamination abuts against the second mounting surface so that the strip-shaped lamp holder 10 can be engaged with the position between the U-shaped groove hook 401 and the light-barrier engaging hook 402 and the post spring lamination 405. The strip-shaped lamp holder 10 can be prevented from loosening due to the elasticity of the post spring lamination 405.

Figure 7:
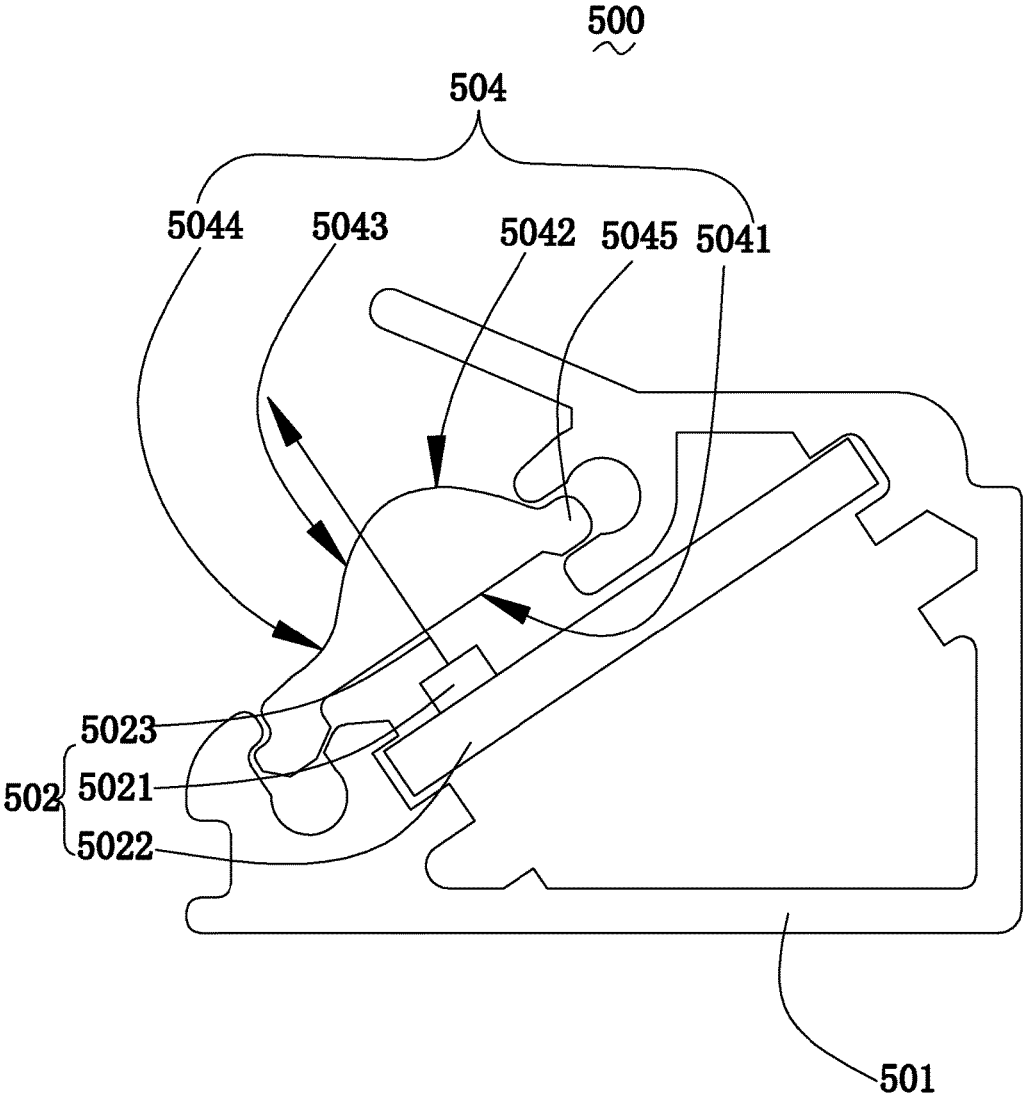
FIG. 7 is a schematic view showing the structure of the LED strip light provided in the fourth embodiment of the present invention.

As shown in FIG. 7, FIG. 7 is a schematic view showing the structure of the LED strip light 500 provided in the fourth embodiment of the present invention. The LED strip light 500 includes a strip-shaped lamp holder 501, and a light-emitting module 502 provided in the strip-shaped lamp holder 501, and a polarizing lens 504 mounted on the strip-shaped lamp holder 501. In the fourth embodiment, the strip-shaped lamp holder 501, the light-emitting module 502 and the laminar mounting clip 503 have the same structure as those of the first embodiment and will not be described in detail here. The difference between the fourth embodiment and the first embodiment is that the lampshade is a polarizing lens 504, the polarizing lens 504 has the same structure as the conventional plate type lampshade. It is necessary to introduce some optical terms to explain it in detail. The light source module 502 includes a circuit board 5021 and a plurality of LED chips 5022 disposed on the circuit board 5021. Each of the LED chips 5022 has an optical axis which is an optical design guide so that the plurality of LED chips 5022 form a face, i.e., an optical axis surface 5023.

Figure 8:
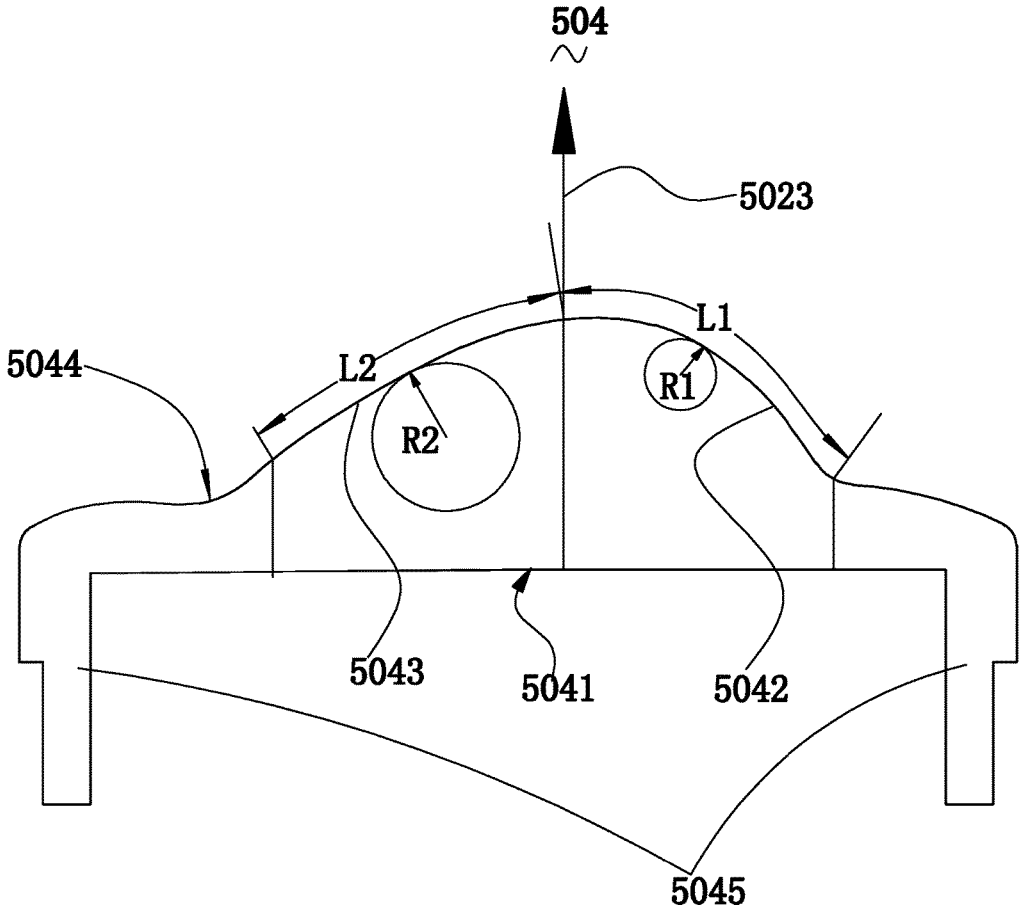
FIG. 8 is a schematic view showing the structure of the polarizing lens of the LED strip light of FIG. 7.

Referring again to FIG. 8, the polarizing lens 504 includes a plane incidence plane 5041 perpendicular to the optical axis surface 5023, a first convex lens exit surface 5042 and a second convex lens exit surface 5043 provided on both sides of the optical axis, and a third concave lens exit surface 5044. It is conceivable that the polarizing lens 504 is also strip. In order to explain the structure of the polarizing lens 504, the present invention explains the polarizing lens 504 in via of the cross section of the polarizing lens 504. The cross-sectional structure of the polarizing lens 504 determines the direction and intensity of the light exit. In addition, in the present embodiment, the polarizing lens 504 further includes two engaging portions 5045 respectively provided on both sides of the first convex lens exit surface 5042 and the third concave lens exit surface 5044. The two engaging portions 5045 are respectively clamped into the first and second lampshade grooves 17, 18 of the strip-shaped lamp holder 10. It is conceivable that the engaging portion 5045 is provided so as to mount the polarizing lens 504 conveniently, and the engaging portion 5045 has no optical effect. In the present embodiment, the polarizing lens 5045 is integrally molded by an injection molding process. A dotted line is introduced to FIG. 3, FIG. 4 and FIG. 5 to distinguish the engaging portion 5045 and the first convex lens exit surface 5042 and the third concave lens exit surface 5044.

It is further noted that the "convex" and "concave" of the first convex lens exit surface 5042 and a second convex lens exit surface 5043 is defined with respect to the optical axis of each of the surface 5023, and the direction of the light determines the convergence or divergence direction of the lens.

The incident surface 5041 may be a plane such that the incident angle of the incident light is regular to design the light exit conveniently.

The arc length and the radius of curvature of the cross section of the contour line of the first convex lens exit surface 5042 perpendicular to the optical axis surface 5023 are larger than that of the corresponding contour line of the second convex lens exit surface 5043 and the irradiation distance of the light emitted from the first convex lens exit surface 5042 is smaller than that from the second convex lens exit surface 5043. Referring to FIG. 5, the arc length and the radius of curvature of the cross section of the contour line of the first convex lens exit surface 5042 perpendicular to the optical axis surface 5023 are L1 and R1 respectively. And the arc length and the curvature of the corresponding contour lines of the second convex lens exit surface 5043 are L2 and R2 respectively. As L1 is greater than L2 and the reciprocal of R1 is greater than the reciprocal of R2, it is conceivable that both the first convex lens exit surface 5042 and the second convex lens exit surface 5043 have a light collection performance. The larger the radius of curvature is, the stronger the converging performance is, and the second convex lens exit surface 5043 which irradiates distantly has a weaker light collection performance with respect to the first convex lens exit surface 5042 which irradiates nearly. In actual applications, the exit light of the first convex lens exit surface 5042 is emitted to the laminates of the first mounting surface 11 which is the cargo area closest to the user, therefore, a strong light is required. Since the exit light of the second convex lens exit surface 5043 is emitted to a side of the shelf according to the second mounting surface 12, and the side of the shelf does not require too much light, the arc length of the second convex lens exit surface 5043 is smaller than that of the first convex lens exit surface 5042 to allow the first convex lens exit surface 5042 to receive more light.

The third concave lens exit surface 5044 is used to diffuse the light arriving at a further distance from the light source module 502 for compensating the area where the second convex lens exit surface 5043 fails to provide sufficient light while the polarizing lens 504 may also use the light of the edge of the LED chip 22. The light emitted from the third concave lens exit surface 5044 is emitted to the side of the second mounting surface 12.

It should be noted that the arcs on the first convex lens exit surface 5042, the second convex lens exit surface 5043, and the third concave lens exit surface 5043 may be a smooth curve or may be connected with a plurality of curves.

It should be noted that the term "arc length" mentioned in the present invention means the length of the curve of the contour line of the first convex lens exit surface 5042 and the second convex lens exit surface 5043 which are intersected to the cross section of the polarizing lens 504 along the optical axis surface 5041. Similarly, the "radius of curvature" mentioned in the present invention means the radius of curvature of the contour line. In the present embodiment, the polarizing lens 504 is an elongated shape, the cross-section of the vertical optical axis surface 5041 is a cross section of the polarizing lens 504. The arc length and the radius of curvature of the cross section of the contour line of the first convex lens exit surface 5042 perpendicular to the optical axis surface 5023 are larger than the arc length and the radius of the corresponding contour line of the second convex lens exit surface 5043, and the light collection power of the second convex lens exit surface 5043 is smaller than that of the first convex lens exit surface 5042. It is conceivable that taking the same irradiation distance into consideration, the smaller the irradiated area from the light source with higher light collection is, the stronger the light energy per unit area is. And the light beam has a divergence, so the farther the irradiation distance is, the larger the irradiation area is. That makes the light energy dispersion. It can be seen that the light source with strong light collection can compensate for the energy dispersion caused by long-range irradiation.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. An LED strip light for cabinet lighting, comprising:

a strip-shaped lamp holder, and a light-emitting module provided in the strip-shaped lamp holder, the strip-shaped lamp holder comprising a first mounting surface and a second mounting surface which are adjacent and perpendicular to each other and two light source slots respectively set at the free ends of the first and second mounting surfaces to install the light-emitting module, the angle between the light source mounting surface formed by the two light source slots and the first mounting surface being an acute angle between 30 and 40 degrees, two mounting grooves being respectively provided on the first mounting surface and the second mounting surface along the extending direction thereof, and one of the mounting grooves being a U-shaped groove and another being a V-shaped groove; the strip-shaped lamp holder further comprises a lampshade connection edge extending perpendicularly to the second mounting surface and a light-barrier reflective strip provided on the free side of the lampshade connection edge, and the angle between the light-barrier reflective strip and the first mounting surface is less than 25 degrees.

2. The LED strip light as claimed in claim 1, wherein the LED strip light further comprises at least one laminar mounting clip provided on the mounting groove, the laminar mounting clip comprises a laminar U-shaped groove engaging portion and a laminar V-shaped groove engaging portion, a laminar mounting abutment plate connecting with the laminar U-shaped groove engaging portion and a laminar V-shaped groove engaging portion, a laminar connecting portion connecting with the laminar V-shaped groove engaging portion, and the laminar mounting abutment plate, the laminar U-shaped groove engaging portion comprises a laminar transition portion vertical to the laminar mounting abutment plate, and an L-shaped structure connecting with the laminar transition portion, one side of the L-shaped structure is connected to the laminar transition portion and the other is clamped into the U-shaped groove, the laminar V-shaped groove engaging portion comprises a laminar engaging edge connecting with the laminar connecting portion, the angle between the laminar engaging edge and the laminar connecting portion is less than or equal to 90 degrees, the laminar engaging edge is clamped into the V-shaped groove, the laminar mounting abutment plate is coupled to the first mounting surface of the strip-shaped lamp holder and a laminar spring extending toward the first mounting surface and abuts against the first mounting surface, the laminar connecting portion is coupled to the second mounting surface of the strip-shaped lamp holder.

3. The LED strip light as claimed in claim 1, wherein the laminar mounting clip further comprises a blocking portion extending vertically from one end of the laminar mounting abutment plate and at least one laminar mounting hole mounted on the laminar mounting abutment plate.

4. The LED strip light as claimed in claim 1, wherein the LED strip light further comprises at least one horizontal cabinet mounting clip provided on the mounting groove, the horizontal cabinet mounting clip comprises a horizontal cabinet U-shaped groove engaging portion, a horizontal cabinet V-shaped groove engaging portion, a horizontal cabinet mounting abutment plate connecting with the horizontal cabinet U-shaped groove engaging portion and a horizontal cabinet V-shaped groove engaging portion, and a horizontal cabinet connecting portion connecting with the horizontal cabinet V-shaped groove engaging portion and the horizontal cabinet mounting abutment plate, the horizontal cabinet U-shaped groove engaging portion comprises a horizontal cabinet transition portion vertical to the horizontal cabinet mounting abutment plate, and an L-shaped structure connecting with the horizontal cabinet transition portion, one side of the L-shaped structure is connected to the horizontal cabinet transition portion and the other is inserted into the U-shaped groove, the horizontal cabinet V-shaped groove engaging portion comprises a horizontal cabinet engaging edge connecting with the horizontal cabinet connecting portion, the angle between the horizontal cabinet engaging edge and the horizontal cabinet connecting portion is less than or equal to 90 degrees, the horizontal cabinet engaging edge is clamped into the V-shaped groove, the horizontal cabinet mounting abutment plate is coupled to the first mounting surface of the strip-shaped lamp holder and comprises a horizontal cabinet spring lamination extending toward the first mounting surface, the horizontal cabinet spring lamination abuts against the first mounting surface, the horizontal cabinet connecting portion is coupled to the second mounting surface of the strip-shaped lamp holder.

5. The LED strip light as claimed in claim 4, wherein the horizontal cabinet mounting clip further comprises a blocking portion extending from the inside of the horizontal cabinet mounting abutment plate and at least one horizontal cabinet mounting hole mounted on the horizontal cabinet mounting abutment plate, the horizontal cabinet mounting hole and the horizontal cabinet U-shaped and V-shaped groove engaging portions are respectively located on both sides of the blocking portion.

6. The LED strip light as claimed in claim 1, wherein the strip-shaped lamp holder further comprises a first lampshade groove provided on the lampshade connection edge and a second lampshade groove provided on the first mounting surface, a lampshade inserted between the first and lampshade grooves, the lampshade is located in the light emitting direction of the light emitting module.

7. The LED strip light as claimed in claim 6, wherein the lampshade is a plate type lampshade made of a translucent material and the lampshade comprises a light-emitting portion, the cross-sectional shape of the light-emitting portion is that the side of the contour line of the light-emitting portion which is in contact with the light-barrier reflective strip is tangent to the light-barrier reflective strip and tangent to the outer end of the second lampshade groove, and the side of the contour line of the light-exit portion which is in contact with the light-barrier reflective strip and the side of the outer end of the second lampshade groove continuously transits.

8. The LED strip light as claimed in claim 6, wherein the lampshade is a polarizing lens, the light source module comprises an optical axis surface, the polarizing lens comprises a incident plane perpendicular to the optical axis surface and a first convex lens exit surface and a second convex lens exit surface provided on both sides of the optical axis, and a third concave lens exit surface, the second convex lens exit surface is located between the first convex lens exit surface and the third concave lens exit surface, the arc length and the radius of curvature of the cross section of the contour line of the first convex lens exit surface along the optical axis are larger than that of the second convex lens and the irradiation distance of the light emitted from the first convex lens exit surface is smaller than that from the second convex lens exit surface, the irradiation distance of the light emitted from the third concave lens is larger than that from the second convex lens.

9. The LED strip light as claimed in claim 1, wherein the LED strip light further comprises at least one post mounting clip provided on the mounting groove, the post mounting clip comprises a U-shaped groove engaging hook, a light-barrier engaging hook and a first post mounting abutment plate connecting with the U-shaped groove engaging hook, a second post mounting abutment plate coupled to the second mounting surface, the U-shaped groove engaging hook is hook up in the U-shaped groove of the strip-shaped lamp holder, the light-barrier engaging hook is hook up at the free end of the light-barrier reflective strip, the second post mounting abutment plate comprises a post spring lamination extending toward the second mounting surface, the post spring lamination abuts against the second mounting surface.

* * * * *